US005532795A

United States Patent [19]

Tatsumi et al.

[11] Patent Number: 5,532,795

[45] Date of Patent: Jul. 2, 1996

[54] METHOD OF AND SYSTEM FOR CLEANING ROLLER MEMBERS

[75] Inventors: Kenzo Tatsumi; Masaru Tanaka, both of Yokohama; Takeo Suda, Tokyo-To, all of Japan

[73] Assignee: Ricoh Company, Ltd., Tokyo, Japan

[21] Appl. No.: 362,644

[22] Filed: Dec. 23, 1994

[30] Foreign Application Priority Data

Dec. 28, 1993 [JP] Japan ..... 5-334485

[51] Int. Cl.[6] ..... G03G 21/00

[52] U.S. Cl. ..... 355/210; 355/219; 355/271; 355/296

[58] Field of Search ..... 355/210, 271–274, 355/219, 296

[56] References Cited

U.S. PATENT DOCUMENTS

| | | | |
|---|---|---|---|
| 4,339,195 | 7/1982 | Gabelman . | |
| 5,132,738 | 7/1992 | Nakamura et al. | 355/219 X |
| 5,150,165 | 9/1992 | Asai | 355/274 |
| 5,182,604 | 1/1993 | Asai | 355/219 X |
| 5,298,953 | 3/1994 | Lindblad | 355/271 |
| 5,303,014 | 4/1994 | Yu et al. | 355/273 |
| 5,331,383 | 7/1994 | Nou et al. | 355/219 X |
| 5,371,575 | 12/1994 | Sekino et al. | 355/271 X |

FOREIGN PATENT DOCUMENTS

| | | |
|---|---|---|
| 2-301779 | 12/1990 | Japan . |
| 3-101768 | 4/1991 | Japan . |
| 3-130787 | 6/1991 | Japan . |
| 3-228081 | 10/1991 | Japan . |

*Primary Examiner*—R. L. Moses
*Attorney, Agent, or Firm*—Lowe, Price, LeBlanc & Becker

[57] ABSTRACT

The clean surfaces of rollers in contact with photoconductive element of an image forming apparatus are cleaned of toner and other contaminants by increasing pressure between the contact surfaces of the roller and the photoconductive element during non-sensitive phases of operation, so that toner and other contaminants are transferred from the rollers to the photoconductive element. Alternatively, the rotational speed of the rollers are decreased, increased or reversed during non-sensitive phases of operation to effect transfer of toner and other contaminants to the photoconductive element for removal by the development station and/or development station. The system and cleaning method, which is particularly useful for charging, transfer and discharging rollers, are applicable to image forming apparatus wherein accumulation of toner and other contaminants decreases the quality of reproduction, require troublesome maintenance, decrease the life of the rollers requiring replacement, and prevents a compact image forming apparatus.

54 Claims, 9 Drawing Sheets

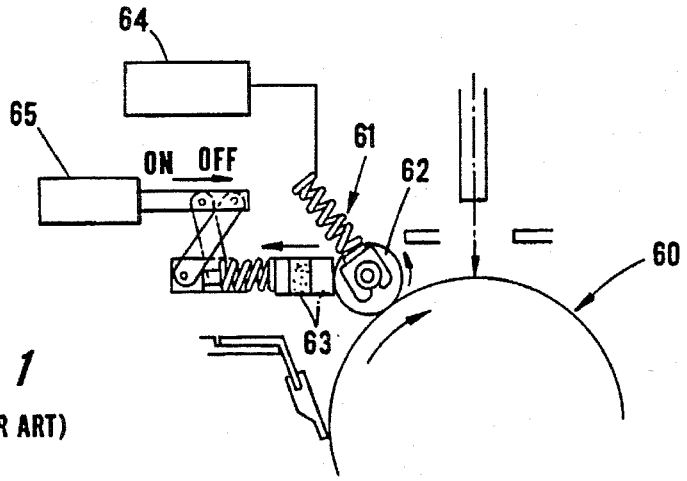
Fig. 1
(PRIOR ART)
Fig. 2A
(PRIOR ART)
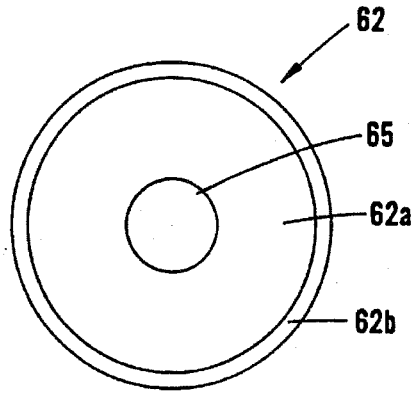
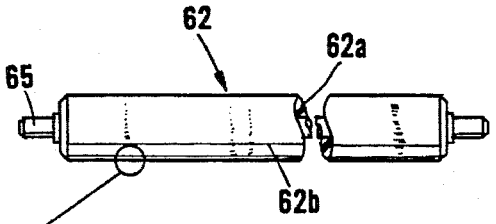
Fig. 2B
(PRIOR ART)
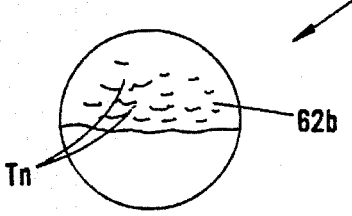
Fig. 2C
(PRIOR ART)

METHOD OF AND SYSTEM FOR CLEANING ROLLER MEMBERS

TECHNICAL FIELD

The present invention relates to roller members, e.g., charging, transfer or discharging rollers, for contacting photoconductive elements, such as drums or belts. The invention has particular applicability to electrophotographic apparatus, such as copiers, printers, facsimile machines and the like.

BACKGROUND ART

Conventional electrophotographic apparatus, such as copiers, printers, facsimile machines, etc., comprise an imaging surface, such as a photoconductive element, normally in the form of a drum or belt. Arranged in timed sequence around the imaging surface are a plurality of processing stations for performing various functions. These processing stations may comprise stations for charging the imaging surface, electrostatically forming a latent image on the imaging surface, developing the latent electrostatic image with a developer commonly referred to as toner, transferring the developed image from the imaging surface to a substrate such as paper, typically by means of a transfer roller, feeding paper to the transferring station, cleaning the imaging surface, i.e., removing residual toner on the imaging surface, and fixing the transferred developed image on the paper.

A typical reproduction operation comprises charging the imaging surface, such as a photoconductive drum, and exposing the charged surface to a light pattern of an original image to be reproduced thereby selectively discharging the imaging surface in accordance with the original image. The resulting pattern of charged and discharged areas on the surface of the photoconductive drum forms an electrostatic charge pattern or electrostatic latent image conforming to the original image.

The latent electrostatic image is developed by contacting it with finely divided toner which is held by electrostatic force on the imaging surface. The toner image is transferred to a substrate, such as paper, in a transferring device into which paper is fed by a registration roller toward the drum in synchronization with drum rotation. As the leading edge of the paper abuts the drum, electrostatic forces adhere the two together, and the transferring device having a transfer roller transfers a toner image from the photoconductive drum to the paper. After transfer, the toner image is fixed to form a permanent record.

Subsequent to development, and after transfer of the developed image to the paper, some toner inevitably remains on the photoconductive drum, held thereto by electrostatic and/or Van der Wals force. Additionally, other contaminants, such as paper fibers, toner additives, Kaolins and various other forms of debris, have a tendency to be attracted to the charge retentive surface.

Contemporary commercial automatic copiers/reproduction machines comprise an electrostatographic imaging surface, which may be in the form of a drum or belt. The imaging surface moves at high rates in timed unison relative to a plurality of processing stations. This rapid movement of the electrostatographic imaging surface requires vast amounts of toner to be employed during development. Associated with the increased amounts of toner is the difficulty in removing residual toner remaining on the imaging surface subsequent to transfer.

One type of device conventionally employed for charging the imaging surface of a photoconductive member is a corona charger normally positioned slightly spaced apart from the surface of the imaging surface for applying a surface charge thereto. Typically, a corona charging device comprises a wire electrode and a shield electrode to which is normally applied a relatively high voltage, on the order of 4 to 8 kilovolts, to induce 500 to 800 volts of surface potential on the imaging surface. Corona chargers are of relatively low charging efficiency, because most of the discharging current from the wire electrode flows to the shield electrode, leaving a small percentage of the total discharging current flowing to the imaging member to be charged.

Another disadvantage attendant upon employing a corona charger is the generation of ozone which constitutes a health hazard and is, therefore, environmentally undesirable. Accordingly, when employing a corona charger it is necessary to install filtering and air distribution systems in any environment in which the electrostatographic apparatus is situated. In addition, image blurring occurs as a result of the oxidation of the image transfer components and deterioration of the photoconductive surface. Still another disadvantage attendant upon employing a corona charger is contamination of the wire electrode by fine dust attracted by the electrostatic field created by the electrode, thereby necessitating periodic cleaning and/or replacement of the wire electrode.

The disadvantages associated with corona chargers have led to the implementation of alternatives to the corona chargers, such as a contact type charge inducing member as disclosed in Japanese Laid Open 3-130787. The disclosed system comprises a contact charge inducing member which is maintained in contact with the surface of a charge receiving member, e.g., a photoconductive drum, thereby charging the photoconductive drum at an advantageously relatively low voltage. Since a discharge is not established, ozone is not generated and the accumulation of dust on the wire electrode avoided.

As shown in FIG. 1, the prior art apparatus comprises photoconductive drum 60, cleaning blade 67 and a contact charge inducing member in the form of charging roller 62 connected to a relatively low voltage power supply 64 via conductive spring 61. The apparatus also comprises cleaning element 63 which is urged into contact with the surface of charging roller 62 upon energizing solenoid 65. Solenoid 65 enables periodic movement of cleaning element 63 into and out of contact with charging roller 62.

In operation, solenoid 65 is normally off so that the armature extends out of solenoid 65 and cleaning element 63 is spaced apart from, i.e., out of contact with, charging roller 62. During operation, toner and other contaminants inevitably accumulate on charging roller 62, as from the surface of drum 60, decreasing its charge inducing efficiency. In addition, such toner and other contaminants tend to redeposit on photoconductive drum 60, resulting in poor quality reproductions. When solenoid 65 is switched on, the armature is drawn into the solenoid, extending cleaning element 63 into contact with charging roller 62 to remove toner and other contaminants therefrom while charging roller 62 rotates due to frictional engagement with photoconductive drum 60.

A conventional charging roller 62, as shown in FIG. 2A, normally comprises a conductive metal core 65 surrounded by a layer of elastomeric material 62*a*, such as rubber or an elastomeric resin, and a surface layer 62*b* having a thickness in the range of about 4 to about 14 microns and a hardness greater than that of underlying layer 62*a*.

Because the underlying layer 62*a* of elastomeric material is inherently formed with surface irregularities, as shown in FIG. 4, the outer surface layer 62*b* conforming to the shape of the underlying layer, is also irregular. This inherent irregular outer surface layer 62*b*, is characterized by a convex and concave surface topography comprising crevices, recesses, etc., renders it particularly receptive to the accumulation of embedded or lodged finely divided material such as toner and other contaminants. Toner is a particularly troublesome contaminant, since its particle size is such that it easily penetrates crevices on the surface of a charge inducing member so that the toner tends to accumulate in the concave portions.

To clean the charge inducing member, various materials have been used for the cleaning element. Japanese Laid Open 2-301779 discloses a felt material and Japanese Laid Open 3-101768 discloses a sponge material for the cleaning element. Japanese Laid Open 2-301779 discloses a cleaning element made of a web or the like material, and Japanese Laid Open 3-101768 discloses a cleaning element which is charged with a polarity opposite that of the contaminant to clean the charge inducing member.

In Japanese Laid Open 3-228081, cleaning roller 3, rather than a cleaning element, is used to remove the toner, paper chips and other contaminants, as shown in FIG. 5. After the toner image is transferred to a substrate, such as paper, at the transfer station using transfer roller 11, cleaning blade 8*a* is used to clean the photoconductive drum 1 to remove remaining toner, paper chips and other contaminants. Cleaning roller 3 cleans photoconductive drum 1 to remove other remaining toner, paper chips and contaminants.

The surfaces of the prior art cleaning elements and rollers accumulate toner and other contaminants, which causes a decline in their cleaning ability, and hence, the charging roller cannot be properly cleaned. With reference to FIG. 2B, toner and other contaminants (Tn) inevitably accumulate and lodge in crevices and recesses on the irregular surface of charging roller 62. Such Tn tends to become embedded or lodged between charging roller 62 and cleaning element 63, as shown in FIG. 3, resulting in the accumulation of Tn on the surface of charging roller 62. In addition, the accumulation of Tn between cleaning element 63 and charging roller 62 creates friction on the surface of charging roller 62 thereby disadvantageously imparting vibrations to the photoconductive element, resulting in poor quality reproduction. After a period of time, the accumulated Tn causes nonuniform charging contributing further to poor quality of reproductions.

To further aggravate the matter, the surface of the transfer roller also accumulates toner and other contaminants. As shown in FIG. 5, transfer roller 11 is in contact with photoconductive drum 1. Toner and other contaminants which remain on photoconductive drum 1 are transferred to transfer roller 11. The accumulation of Tn on transfer roller 11 generates nonuniform transfer conditions during transfer of the toner image to the substrate, resulting in poor quality reproductions.

Although not shown in the figures depicting the prior art, a discharging roller is normally provided in contact with the photoconductive drum to remove any charge remaining on the drum after imagewise exposure. The discharging roller, however, is also susceptible to accumulation of toner and contaminants transferred from the photoconductive drum, resulting in improper discharging of the photoconductive drum which degrades the quality of reproduction.

To correct such problems, service personnel must periodically clean the charging, transfer and/or discharging rollers. In situations where the rollers cannot be adequately cleaned, they must be replaced. In addition to such frequent and troublesome maintenance, conventional electrostatographic apparatus require cleaning elements and toner containers for collecting the toners and other contaminants, which create obstacles for compactness.

DISCLOSURE OF THE INVENTION

An object of the present invention is an image forming apparatus which reproduces images of improved quality.

Another object is improved cleaning of a direct contact type roller member.

A further object is improved cleaning of transfer and discharging rollers of an image forming apparatus.

Another object is more effective removal of accumulated toner and other contaminants from the surface of a direct contact type roller member of a photocopier or other electrostatic image forming apparatus.

A further object of the present invention is to reduce required maintenance of electrophotographic apparatus by service personnel.

A further object of the present invention is to reduce the size of electrostatic image forming apparatus.

A still further object of the invention is to prolong the life of a direct contact type roller member.

Additional objects, advantages and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

According to the present invention, the foregoing and other objects are achieved in part by an apparatus comprising a photoconductive element, a roller member in contact with the photoconductive element, and transfer means for transferring toner and other contaminants from the roller member to the photoconductive element.

Another aspect of the invention is an apparatus comprising a photoconductive element, a roller maintained in contact with the photoconductive element, and pressure varying means for varying the pressure between contact surfaces of the photoconductive element and roller, wherein the pressure varying means applies a first pressure during sensitive phases of operation, and a second pressure, greater than said first pressure, during non-sensitive phases of operation, between contact surfaces of the photoconductive element and roller.

A further aspect of the invention is an apparatus comprising a photoconductive element capable of rotating at a first rotational speed, a roller in contact with the photoconductive element and capable of rotating at a second rotational speed, and control means for controlling the rotational speeds of the photoconductive element and roller so that the first and second rotational speeds are equal during sensitive phases of operation, but different during non-sensitive phases of operation.

Still another aspect of the invention is an image forming apparatus comprising means for creating a latent image on a photoconductive surface, means for converting the latent image into a developed image, means for transferring the developed image onto a predetermined image medium, and means for cleaning toner and other contaminants remaining on the photoconductive surface. Preferably, the apparatus comprises at least one roller means maintained in contact with the photoconductive surface for charging or discharging the photoconductive surface or for transferring the developed image onto the predetermined image medium. Preferably, also included is a means for transferring toner and other contaminants from the roller to the photoconductive surface.

A further aspect of the invention is a method of removing toner and other contaminants from a roller of an image forming apparatus, which method comprises rotating a photoconductive element of the apparatus at a first rotational speed, rotating the roller at a second rotational speed, with the roller in contact with the photoconductive element, and transferring toner and other contaminants from the roller to the photoconductive element for subsequent removal from the element.

BRIEF DESCRIPTION OF DRAWINGS

The invention will be described in detail with reference to the following drawings in which like reference numerals refer to like elements.

FIG. 1 is a schematic drawing of a portion of an image forming apparatus containing a prior art cleaning element.

FIG. 2A is a cross sectional view of a conventional charging roller.

FIG. 2B is a schematic drawing of a charging roller showing accumulated contamination.

FIG. 2C is an exploded view of an area of a charging roller shown in FIG. 2B.

DESCRIPTION OF THE INVENTION

Figure 3:
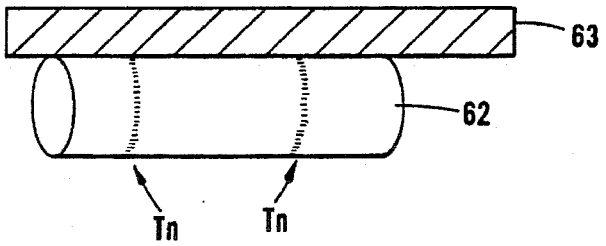
Fig. 3 (PRIOR ART)
FIG. 3 shows contaminants lodged between a charge inducing member and cleaning element.
Figure 4:
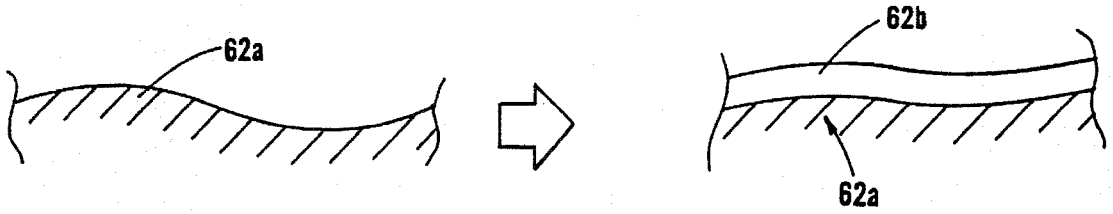
Fig. 4 (PRIOR ART)
FIG. 4 shows the formation of an irregular topology on the surface of a charge inducing member.
Figure 5:
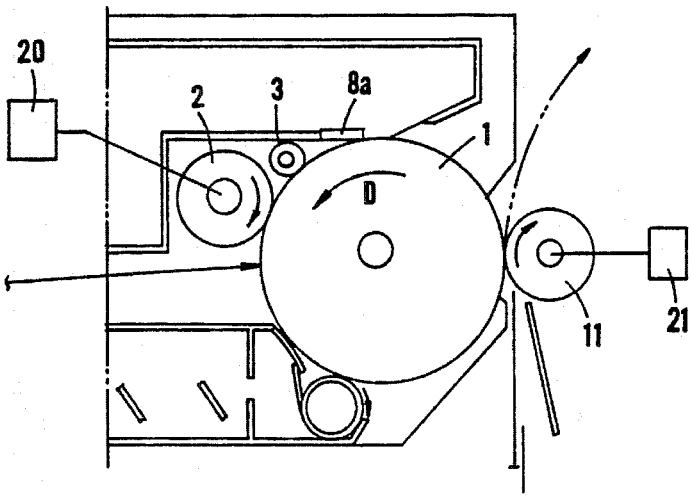
Fig. 5 (PRIOR ART)
FIG. 5 shows a conventional image forming apparatus using a cleaning roller.
Figure 6:
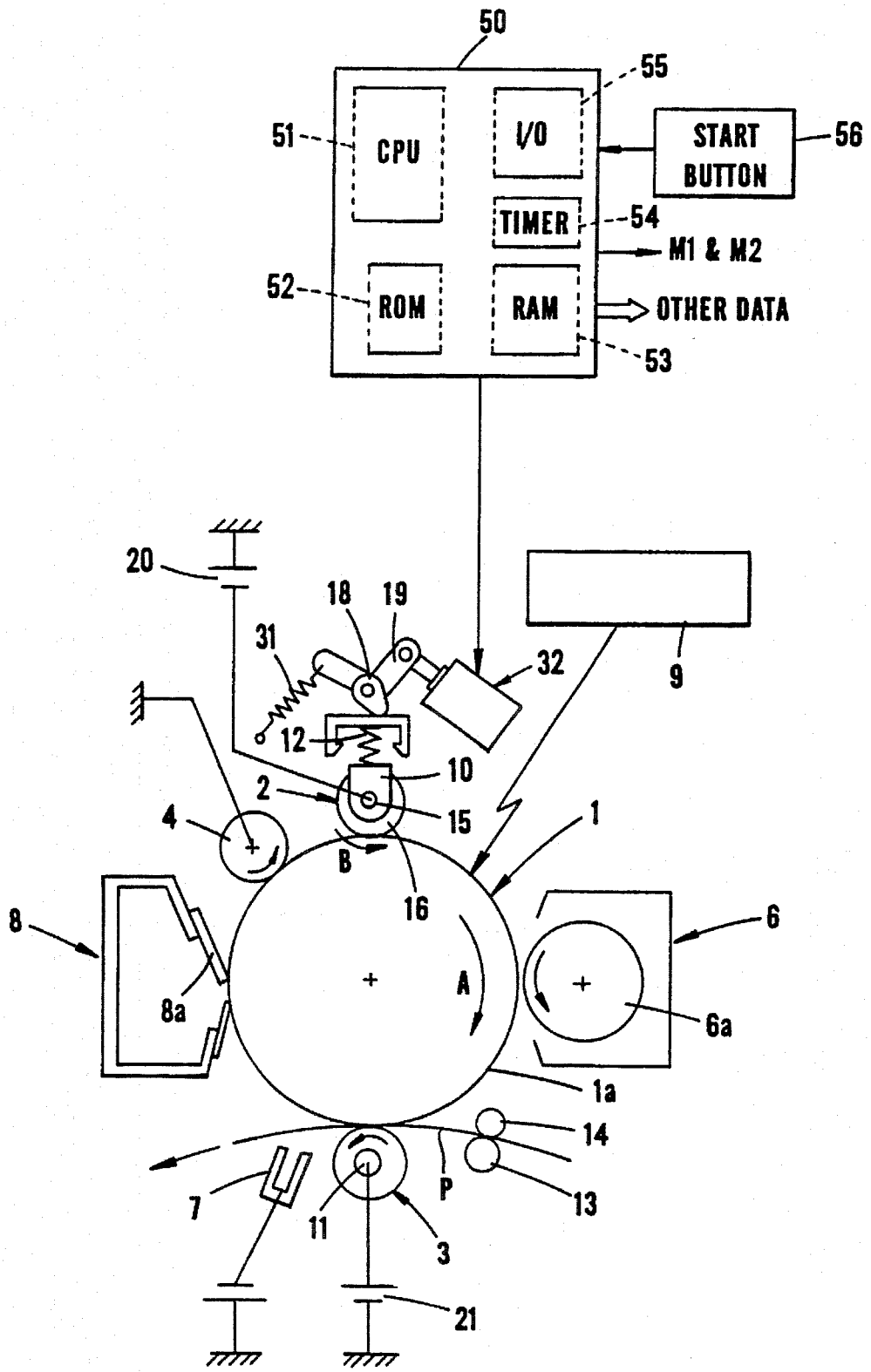
FIG. 6 is a schematic drawing of an image forming apparatus incorporating a first embodiment of the present invention.

Referring to FIG. 6, depicting an image forming apparatus incorporating a first embodiment of the present invention, photoconductive drum 1 comprises an electrically conductive base and photoconductive layer 1*a*, such as a photoconductive semiconductor layer of an organic photoconductor, amorphous silicon, selenium or the like. Photoconductive drum 1 rotates, driven by a motor, timing belt and pulley arrangement (not shown), at a predetermined speed in the direction indicated by arrow A sequentially in relation to a plurality of processing stations disposed about its rotational path of movement. As used herein, "downstream" refers to a location along photoconductive drum 1 in the process direction; "upstream" refers to a location along the circumference of photoconductive drum 1 in a direction opposite the process direction.

With continued reference to FIG. 6, charging roller 2 contacts the surface of photoconductive drum 1 under a first predetermined pressure P1 and rotates in the direction indicated by arrow B with the rotation of photoconductive drum 1. During image formation on a prescribed image area, charging roller 2, supplied with voltage V from external source 20, charges photoconductive drum 1 to a substantially uniform potential, either positive or negative. Imagewise exposure is conducted downstream at station 9, wherein light rays reflected from an original document are passed through a lens and projected onto a charged portion of the surface of photoconductive drum 1 to selectively dissipate the charge thereon. Such selective charge dissipation records an electrostatic latent image on the circumference of photoconductive drum 1 corresponding to the informational area contained within an original document. Alternatively, a laser may be provided to imagewise discharge the photoconductive drum 1 in accordance with stored electronic information.

Thereafter, photoconductive drum 1 rotates downstream to development station 6 where a rotating member 6a advances a developer mix (e.g., carrier particles and toner) into contact with the latent electrostatic image. The toner particles are attracted away from the carrier beads by the latent electrostatic image, thereby forming toner powder images (developed images) on the surface of photoconductive drum 1. The development station may apply one or more colors of developer material.

Photoconductive drum 1 then rotates downstream advancing the developed latent image to a transfer station. At the transfer station, a sheet of support material or substrate, such as a paper copy sheet P, is advanced into contact with the developed latent images by cooperating register roller 13 and pressure roller 14. The toner powder image is transferred from photoconductive drum 1 to paper P.

To attract and permanently affix the developed images onto paper P, transfer roller 3 is biased by external voltage 21 with polarity opposite that of the developed images. Paper P is separated from photoconductive drum 1 by separating member 7, which is charged with a polarity opposite that of paper P by an external voltage (not labelled).

Residual toner and other contaminants on photoconductive drum 1 are removed at downstream cleaning station 8 by cleaning blade 8*a*. Any remaining electric charge on photoconductive drum 1 is removed by downstream discharging roller 4. Photoconductive drum 1 is then ready to be charged again by charging roller 2 for image formation.

The apparatus depicted in FIG. 6 utilizes a contact charging roller 2 rather than a corona charging device and, therefore, avoids the disadvantages appurtenant to corona charging. However, as previously noted, a disadvantage of a contact type charging roller is the accumulation of toner and other contaminants on the surface of the charging roller. The present invention, shown with elements 12, 18, 19, 31, and 32 in FIG. 6, confronts and solves the prior art problem of ineffective cleaning of accumulated toner and other contaminants on the irregular surface of a charge inducing member. This is achieved by transferring toner and other contaminants embedded in topographical recesses and crevices on the surface of a charge inducing roller to the photoconductive drum for removal by rotating member 6*a* of development station and/or cleaning blade 8*a* of cleaning station 8.

In accordance with the present invention, toner and other contaminants are transferred from a roller, such as a charge inducing roller, to a photoconductive member, such as a photoconductive drum, by increasing the frictional force between the photoconductive member and roller during non-sensitive phases of operation. Such frictional force can be increased in various way, e.g., by increasing the pressure between the contact surfaces of the photoconductive element and roller or by changing or reversing the rotational speed of the roller. Those having ordinary skill in the art would readily recognize that the sensitive phases of operation include phases during which the quality of reproduction may be adversely affected by cleaning the rollers, e.g., imagewise exposure of the photoconductive element, development of a latent electrostatic image and transfer of a developed image. Accordingly, non-sensitive phases of operation include those phases other than the sensitive phases during which the quality of reproduction may be adversely affected by cleaning the rollers.

Thus, by the present invention, the charge inducing member, e.g. roller, is maintained free from toner and other contaminants for extended periods of time thereby resulting in higher quality reproductions. As shown in FIG. 6, the transfer and discharging rollers are in contact with photoconductive drum 1, and hence, are also susceptible to the accumulation of toner and other contaminants. As can be appreciated, the present invention is also applicable to transfer and discharging rollers.

Figure 7:
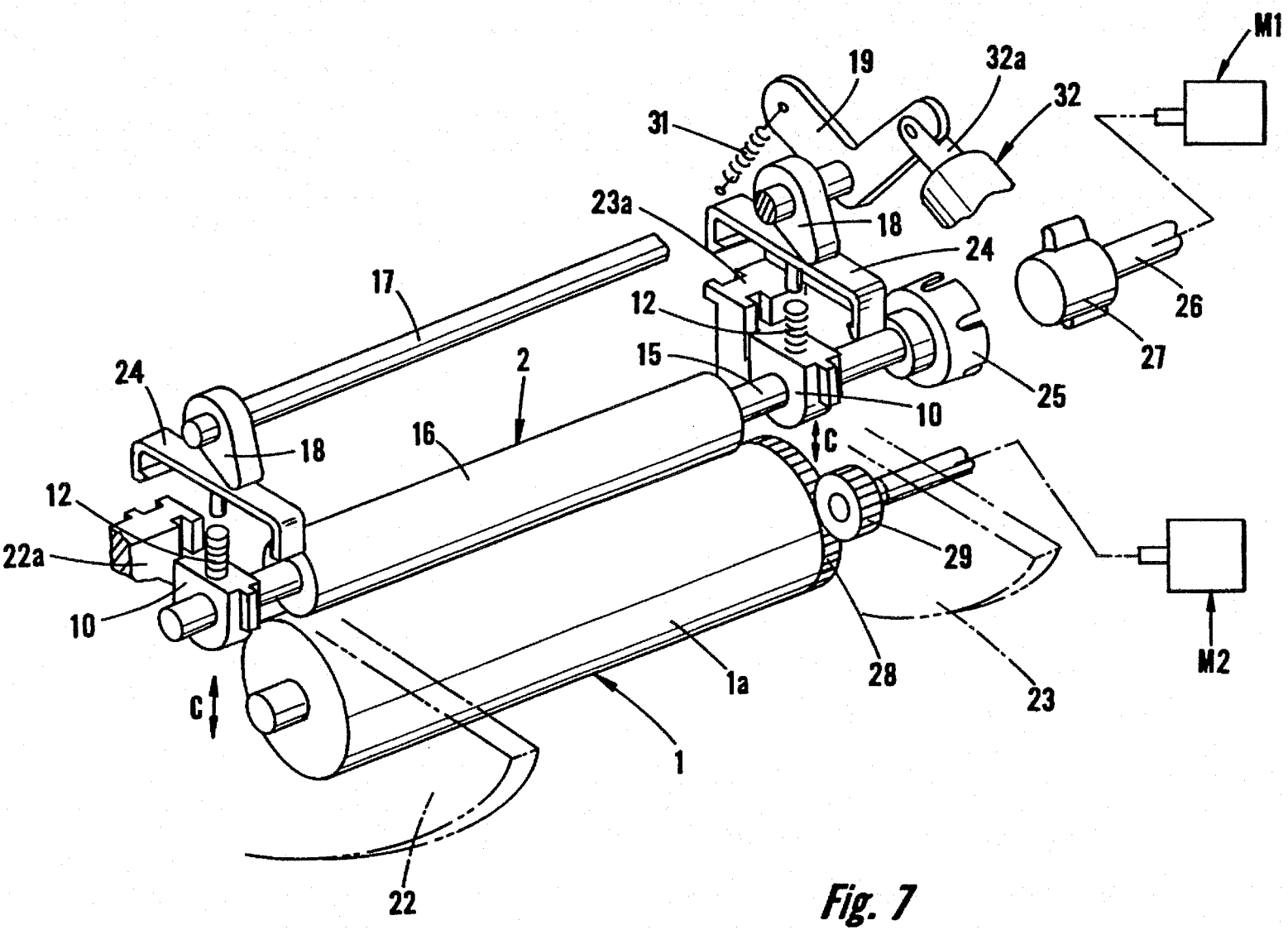
FIG. 7 is a detailed illustration of the first embodiment.

A first embodiment of the present invention is shown in FIG. 7, wherein photoconductive drum 1 is driven by motor M2 using gears 28 and 29. Photoconductive drum 1 is charged by charging roller 2 when charging roller 2 is urged against photoconductive drum 1 at a first predetermined pressure P1 by compression of springs 12. Charging roller 2 can be a conventional charging roller comprising metal core rod 15 and surrounding elastomeric layer 16, such as an EPDM elastomer. Metal core rod 15 is rotatably supported by bearings 10 at both ends. Charging roller 2 is rotated by motor M1 through the connection of metal core rod 15, female-male couplers 25 and 27 and driving shaft 26.

In accordance with a first embodiment, pressure varying means are provided to vary the pressure between the contact surfaces of the photoconductive element and roller to effect a change in the frictional force therebetween. Thus, the first embodiment includes pressure varying means for varying the pressure at the contact surfaces between charging roller 2 and photoconductive drum 1 i.e. to increase the pressure during non-sensitive phases of operation to effect transfer of toner and other contaminants to drum 1 for subsequent removal by rotating member 6*a* and cleaning blade 8*a*. The pressure varying means comprises, for example, solenoid 32, moveable shaft 32*a*, L-shape plate 19, spring 31, cams 18, shaft 17 and U-shaped covers 24 and springs 12.

Pressure can be varied employing different means. For example, with continued reference to FIG. 7, bearings 10 are supported within slots 22*a* and 23*a* of side guide plates 22 and 23 to be moveable in direction C. Both cams 18 contact U-shaped covers 24 and have the same position or angle on shaft 17. The position of cams 18 changes the compression of springs 12. Solenoid 32 is turned on or off to move moveable shaft 32*a*, which causes L-shaped plate to rotate about shaft 17 and further extends spring 31. The rotation of L-shaped plate 19 causes cams 18 to rotate with shaft 17. Rotation of cams 18 moves cover 24 in direction C to change the compression of springs 12, which moves bearings 10 within slots 22*a* and 23*a*, changing the pressure between the contact surfaces of charging roller 2 and photoconductive drum 1.

Figure 8A:
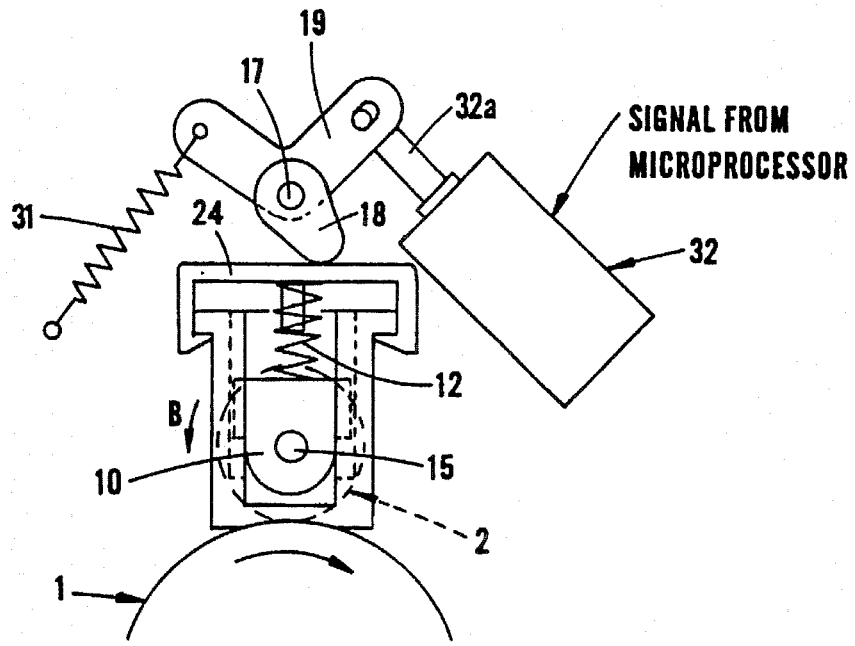
FIGS. 8A and 8B depict different positions of the pressure varying means implemented in the first embodiment of FIG. 7.
Figure 8B:
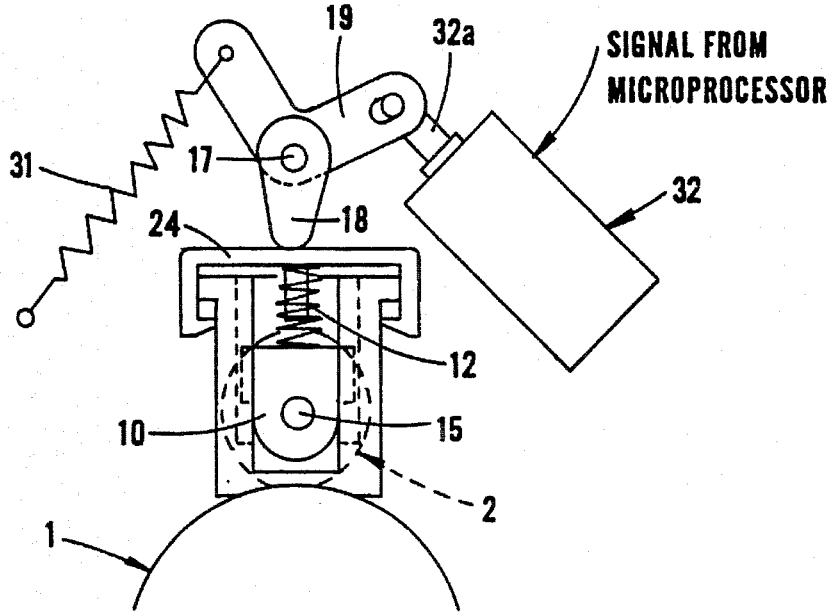

FIGS. 8A and 8B illustrate different positions of cams 18 of the pressure varying means. In FIG. 8A, springs 12 are compressed somewhat due to the position of cams 18 even though solenoid 32 is at an off state. The compression of springs 12 urges charging roller 2 against photoconductive drum 1 at pressure P1 within the sensitive phases of the reproduction process, such as imagewise exposure of the photoconductive drum 1, development of the latent electrostatic image and transfer of the developed image.

During non-sensitive phases of the reproduction process, i.e., phases other than the sensitive phases during which cleaning may adversely affect the quality of reproduction, solenoid 32 is energized to retract moveable shaft 32*a*, causing L-shaped plate 19 to pivot about shaft 17 and further extends spring 31, as shown in FIG. 8B. L-shaped plate 19 acts as a lever to rotate cam 18 to the position shown in FIG. 8B, and to exert further downward pressure on cover 24. Covers 24, in turn, exert a downward force on springs 12 to further compress springs 12 and to move bearings 10 in direction C within slots 22*a* and 23*a* of side guide plates 22 and 23.

Hence, the pressure between the contact surfaces of charging roller 2 and photoconductive drum 1 is increased to a second predetermined pressure P2, which is sufficiently greater than the first pressure P1 to change the frictional force between the roller and drum to effect transfer of toner and other contaminants from the roller to the drum. With increased pressure P2 imparted from roller 2 to drum 1, remaining toner and other contaminants are, therefore, transferred from the surface of charging roller 2 to photoconductive drum 1. The transferred toner and other contaminants on photoconductive drum 1 are then removed by rotating member 6*a* of development station 6 and/or cleaning blade 8*a* of cleaning station 8.

This operation is preferably microprocessor-controlled. As shown in FIG. 6, microprocessor 50 comprises CPU 51, an ROM 52 having a suitable program for energizing solenoid 32 during only non-sensitive phases of the reproduction process, an RAM 53 to store the input data from CPU 51, a timer 54, and I/O 55. ROM 52 is preferably programmed so that solenoid 32 is energized during only the time that photoconductive drum 1 is not being exposed.

Also shown is start button 56, positioned on an operations panel (not shown), for transmitting an initiation signal to microprocessor 50. The operations panel may also contain means for displaying and selecting paper size, brightness or toner density, enlargement, reduction, color, number of sides reproduced, number of copies, means for displaying instructions, troubleshooting information, etc. In operation, when button 56 is depressed, a signal is sent to microprocessor 50, together with data from selections on the operations panel, such as paper size and toner density. Microprocessor 50 then outputs signals to drive motors M1 and M2 and signals to drive the other elements of the apparatus, including signals to illuminate the apparatus panel (not shown). During the non-sensitive phases of operation, microprocessor 50 generates an output signal to energize solenoid 32. In the embodiment depicted in FIG. 6, voltage source 20 generates a potential, for example, of 500 volts, which passes through conductive spring 12, and conductive bearing 10 to conductive core 15 of charging roller 2.

Figure 9A:
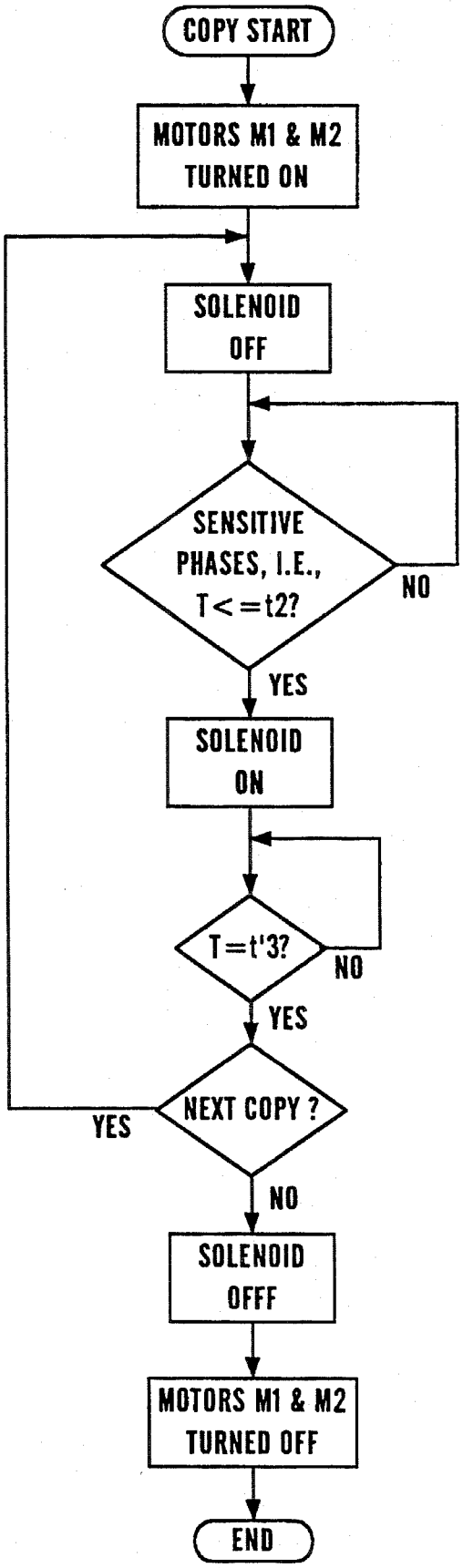
FIGS. 9A and 9B are a flow chart and signal timing chart, respectively, for operating the first embodiment of the present invention.
Figure 9B:
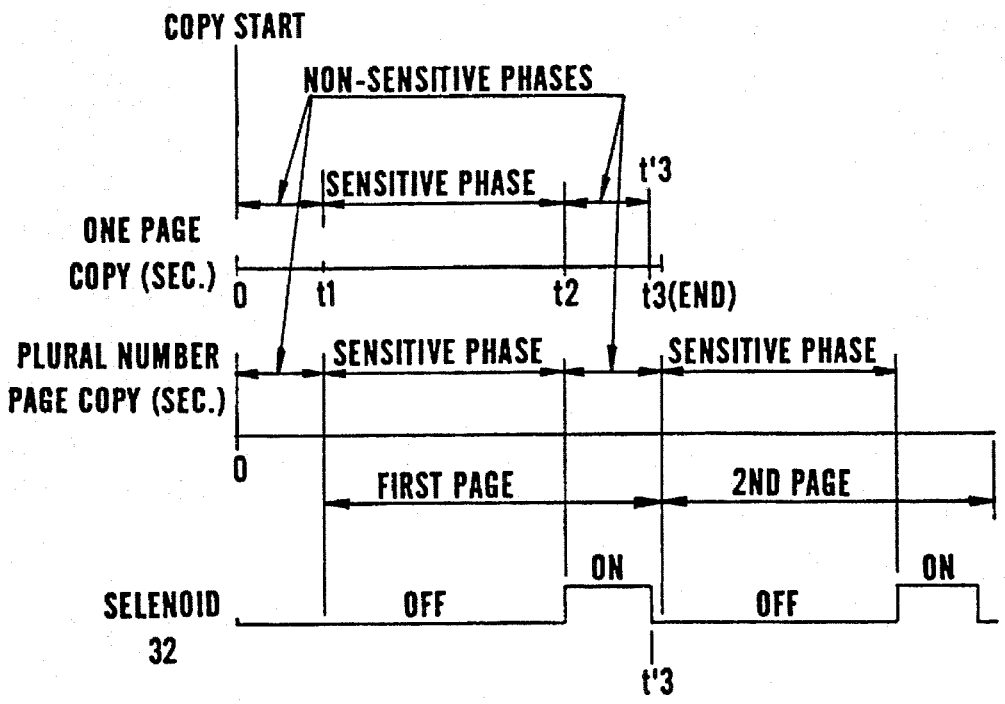

FIGS. 9A and 9B are a flow chart and signal timing chart, respectively, for explaining operation of the first embodiment of the present invention. When start button 56 is depressed, motors M1 and M2 are turned on to rotate charging roller 2 in direction B and to rotate photoconductive drum in direction A at the same peripheral speed. As can be appreciated, motor M1 can be omitted, and charging roller 2 can rotate by virtue of frictional contact with photoconductive drum 1.

The initial status of solenoid 32 is off, and charging roller 2 contacts photoconductive drum 1 with pressure P1, as shown in FIG. 8A. Solenoid 32 remains at an OFF state during the sensitive phase. For example, between time t1 and t2 of the sensitive phase (FIG. 9B), solenoid 32 remains OFF. After time t2, when the drum 1 has advanced to a non-sensitive phase, solenoid 32 is turned ON such that cams 18 press down on covers 24 to press charging roller 2 against photoconductive drum 1 with pressure P2, as shown in FIG. 8B. Solenoid 32 remains ON until the next sensitive phase occurs at time t'3. If there are other copies to be made, these steps are repeated with solenoid 32 turned OFF. If not, solenoid 32 and motors M1 and M2 are turned OFF to end the copying process.

Figure 9C:
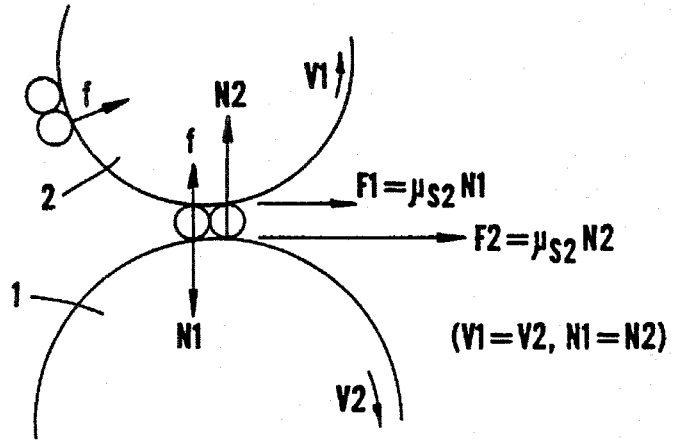
FIGS. 9C and 9D are illustrations providing an explanation of the first embodiment for transferring toner and other contaminants from the charging roller to the photoconductive drum.
Figure 9D:
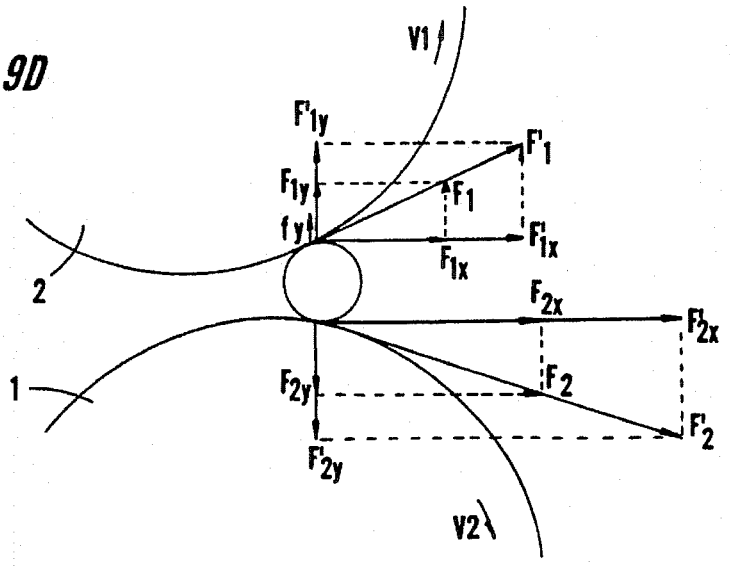

FIGS. 9C and 9D are illustrations providing an explanation of the peripheral mechanism for transferring toner and other contaminants from charging roller 2 to photoconductive drum 1 due to increased pressure caused by the pressure varying means of the first embodiment. The following preliminary discussion of the relative frictional forces on the roller and drum surfaces to toner transfer will be helpful for better understanding of the invention.

The coefficients of static and kinetic friction depend primary on the nature of the surfaces in contact, being relatively large if the surfaces are rough, and relatively small if they are smooth. The surface of charging roller 2 is coated with a fluorine-type resin, and the surface of photoconductive drum 1 is coated with a polycarbonate type resin. With such surfaces, the coefficient of static friction $\mu_{S1}$ between charging roller and toner or other contaminants is less than the coefficient of static friction $\mu_{S2}$ between photoconductive drum 2 and toner or other contaminants, i.e., $\mu_{S1}<\mu_{S2}$. Coefficient of static friction $\mu_{S1}$ ranges from 0.2 to 0.37, and coefficient of static friction $\mu_{S2}$ ranges from 0.5 to 0.65.

FIG. 9C depicts the forces acting on accumulated toner as toner contacts both charging roller 2 and photoconductive drum 1 when motors M1 and M2 rotate charging roller 2 and photoconductive drum 1 at the same rotational speed, i.e., V1=V2. Accumulated toner is held to charging roller 2 by adherence force f. Since charging roller 2 is in contact with photoconductive drum 1 under pressure P1, charging roller 2 exerts normal force $N_1$ on toner, and photoconductive drum 1 exerts normal force $N_2$ on toner, where $N_1$ and $N_2$ are equal and opposite forces (hereinafter referred to collectively as N.

The force parallel to the surface of contact (friction) can be static or kinetic friction, but is directly proportional to the normal force, i.e., friction equals product of the coefficient of friction and the normal force. When toner contacts both charging roller 2 and photoconductive drum 1, static friction $F_1$ imparted to the toner from charging roller 2 is equal to $\mu_{S1}N$, and static friction $F_2$ to toner from photoconductive drum 1 is equal to $\mu_{S2}N$. Both static frictions $F_1$ and $F_2$ are larger than the adherence force f of toner to charging roller 2, and toner moves with the surfaces of charging roller 2 and photoconductive drum 1. The relevant equations are as follows:

$$F_1=\mu_{S1}*N$$

$$F_2=\mu_{S2}*N$$

$$f<<F_1 \text{ and } f<<F_2$$

FIG. 9D depicts frictional forces exerted on toner near the end of the surface contact between charging roller 2 and photoconductive drum 1, which determine whether toner is transferred to charging roller 2 or photoconductive drum 1. The following equations (1) and (2) set forth the static friction to toner from charging roller 2, and equations (3) and (4) set forth the static friction to toner from photoconductive drum 1 during sensitive and non-sensitive phases of the operation, where N' represents the normal force due to increased pressure P2.

| | | |
|---|---|---|
| Sensitive phase | $F_1= \mu_{S1} * N$ | (1) |
| Non-sensitive phase | $F_1' = \mu_{S1} * N'$ | (2) |
| Sensitive phase | $F_2= \mu_{S2} * N$ | (3) |
| Non-sensitive phase | $F_2' = \mu_{S2} * N'$ | (4) |

Increased pressure P2 is applied between charging roller 2 and photoconductive drum 1 during non-sensitive phases of operation; and, hence, the normal force N' during non-sensitive phases is much greater than the normal force N during sensitive phases of operation, i.e., N'>>N. Preferably, the normal force N ranges from 1.5 to 3 Newtons within the sensitive phases; the normal force N' ranges from 10 to 15 Newtons during non-sensitive phases of operation. FIG. 9D also shows the vertical force vectors y and horizontal force vectors x of each force. The vertical vectors of forces f, $F_1$, $F_1'$, $F_2$ and $F_2'$ determine whether toner adheres to charging roller 2 or toner transfers to photoconductive drum 1.

During sensitive phases of operation, vertical vector $F_{1y}$ of friction $F_1$ and vertical vector $f_y$ of adherence force f are exerted from charging roller 2 the to toner while vertical vector $F_{2y}$ of friction $F_2$ is exerted from photoconductive drum 1 to the toner. As discussed above, coefficient $\mu_{S1}$ is smaller than coefficient $\mu_{S2}$, and hence, friction $F_1$ and its vertical vector $F_{1y}$ are smaller than friction $F_2$ and its vertical vector $F_{2y}$, respectively. However, because forces $F_1$ and $F_2$ are relatively small, adherence force f and its vertical component $f_y$ become factors to prevent transfer of toner from charging roller 2 to photoconductive drum 1. In other words, the sum of vertical vectors $F_{1y}$ and $f_y$ is greater than vertical vector $F_{2y}$ as shown below.

$$F_{1y}+f_y>F_{2y}$$

Hence, toner and other contaminants do not transfer from charging roller 2 to photoconductive drum 1.

During non-sensitive phases of operation, vertical vector $F_{1y}'$ of friction $F_1'$ and vertical vector $f_y$ of adherence force f are exerted from charging roller 2 to toner while vertical vector $F_{2y}'$ of friction $F_2'$ is exerted from photoconductive drum 1 to toner. Due to the increased pressure, friction $F_1'$ and $F_2'$ are large forces, and adherence force f and its vertical vector $f_y$ are of negligible values. Hence, the sum of $F_{1y}'$ and $f_y$ is smaller than $F_{2y}'$ as shown below, $$F_{1y}'+f_y<F_{2y}'$$

and toner is transferred from charging roller 2 to photoconductive drum 1.

Figure 9E:
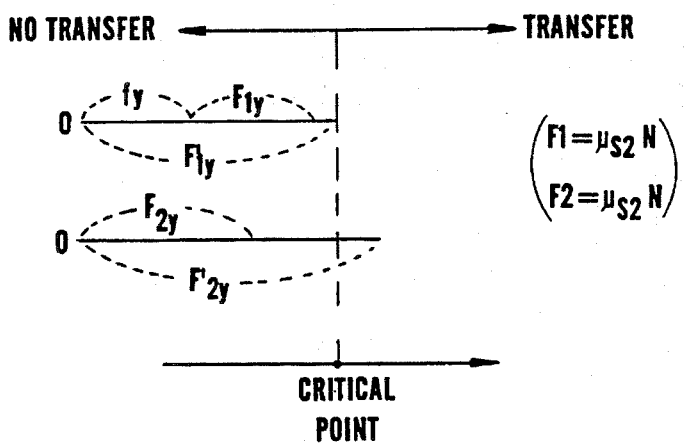
FIG. 9E is a line chart showing the forces exerted on toner in the first embodiment.

FIG. 9E is a line chart showing the forces exerted on toner. As shown, the sum of vectors $f_y$ and $F_{1y}$ is greater than $F_{2y}$, and there is no transfer of toner from charging roller 2 to photoconductive drum 1. However, when increased pressure P2 is applied during non-sensitive phases of operation, vertical vectors $F_{2y}'$ of friction $F_2'$ surpasses a critical point for transferring toner to photoconductive drum 1. The line chart also illustrates that $F_{2y}'$ is greater than the sum of $f_y$ and $F_{1y}'$.

Motors M1 and M2 are used to drive charging roller 2 and photoconductive drum 1. However, motor M1 can be omitted, and charging roller 2 can rotate by virtue of frictional contact with photoconductive drum 1. The explanation for the transfer mechanism during sensitive phases of operation when motor M1 is omitted is the same as when motor M1 is included. When increased pressure P2 is applied during non-sensitive phases of operation, toner starts to slip on charging roller 2 near the end of the surface contact between charging roller 2 and photoconductive drum 1.

Since there is slippage, there is no longer a static friction exerted from charging roller 2 to toner, but rather, kinetic friction $F_{k1}'$. As is well known, coefficient of kinetic friction is smaller than coefficient of static friction. Hence, the sum of vertical kinetic vector $F_{k1y}'$ of static friction $F_1'$ and adherence vertical vector $f_y$ exerted on toner from charging roller is even smaller than vertical static vector $F_{1y}'$ and adherence vertical vector $f_y$, i.e., $$F_{k1y}'+f_y<F_{1y}'+f_y.$$

As before, vertical vector $F_{2y}'$ of friction $F_1'$ exerted from photoconductive drum 1 to toner is larger than either sum, and toner is transferred to photoconductive drum 1.

Figure 10C:
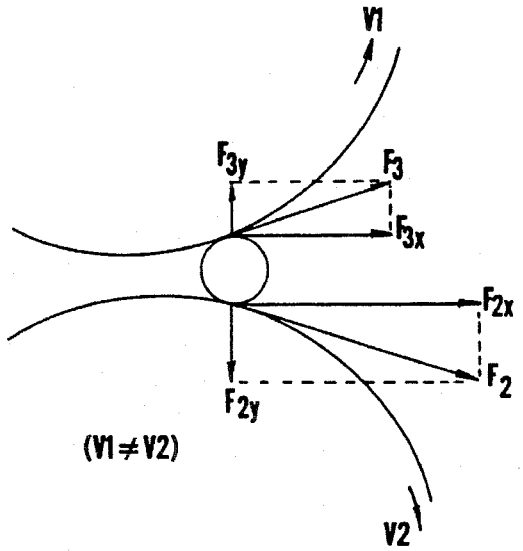
FIG. 10C shows the frictional forces on toner near the end of surface contact within the non-sensitive phases of the second and third embodiments.
Figure 10A:
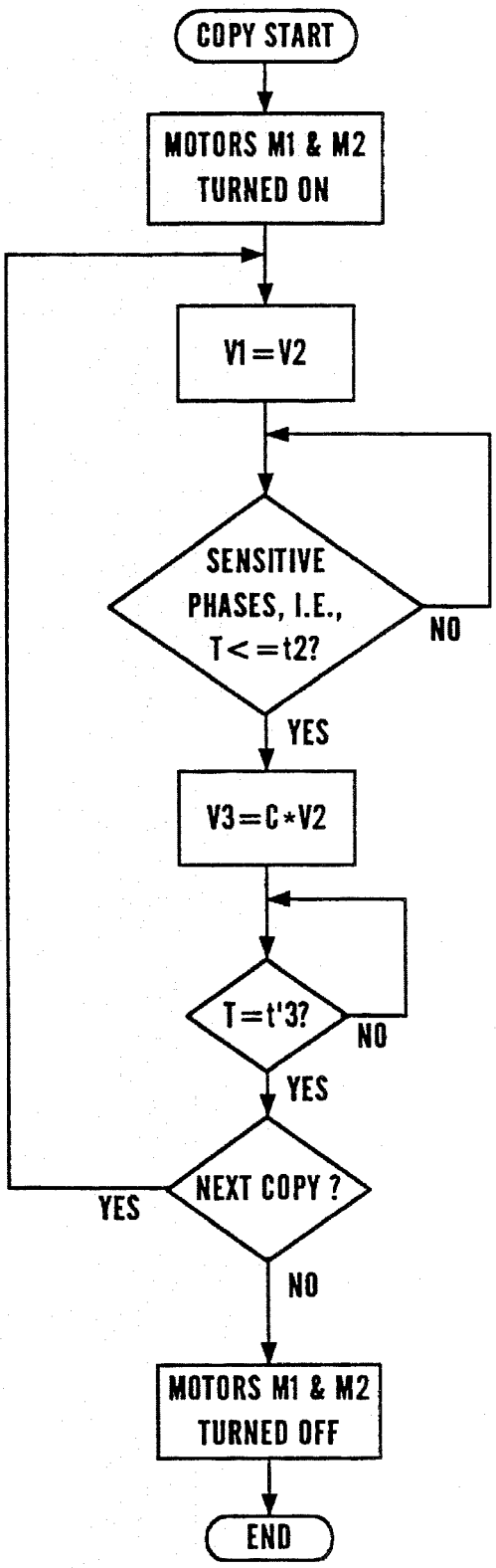
FIG. 10A is a flow chart describing operation of a second embodiment of the present invention.

FIG. 10A is a flow chart for explaining operation of a second embodiment of the present invention to transfer toner and other contaminants from charging roller 2 to photoconductive drum 1. This embodiment lacks the pressure varying means, but uses differences in peripheral speeds of charging roller 2 and photoconductive drum 1 to transfer toner and other contaminants to photoconductive drum 1. Except for the pressure varying means, the construction of the electrophotographic apparatus is the same as shown in FIG. 6.

When start button 56 is depressed, motor M1 is turned on to rotate charging roller 2 with rotational speed V1 in direction B and motor M2 is turned on to rotate photoconductive drum 1 with rotational speed V2 in direction A, where rotational speeds V1 and V2 both are greater than zero. Rotational speeds V1 and V2 are equal to each other during sensitive phases of operation, e.g., between time T=t1 and T=t2 of FIG. 9D.

After time T≧t2 (during non-sensitive phases of operation), the rotational speed of charging roller 2 is changed to V3=C×V1, where C is a constant with a range preferably of 0 to 0.5 and 1.5 to 10, while the rotational speed of photoconductive drum is maintained at speed V2. Toner and other contaminants are transferred from charging roller 2 to photoconductive drum 1 due to differences in rotational speeds during non-sensitive phases of operation. Transferred toner and other contaminants are removed by rotating member 6*a* of developing station 6 and/or cleaning station 8.

The differences in rotational speeds are maintained until a sensitive phase of the operation occurs at time T=t'3. If there are other copies to be made, the above steps are repeated, with rotational speed V1 of charging roller 2 and rotational speed V2 of photoconductive drum being equal to one another. If there are no other copies to be made, motors M1 and M2 are turned OFF to end the copying process.

Figure 10B:
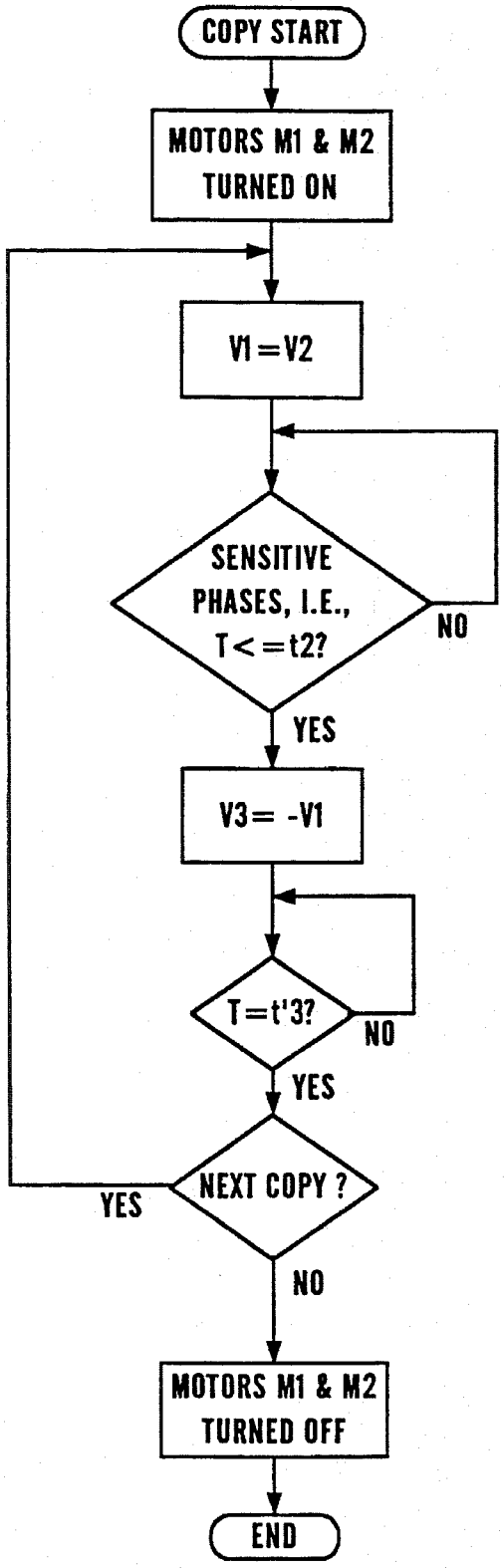
FIG. 10B is a flow chart describing operation of a third embodiment of the present invention.

FIG. 10B is a flow chart for explaining the operation of a third embodiment of the invention to transfer toner and other contaminants from charging roller 2 to photoconductive drum 1. As in the second embodiment, the third embodiment also lacks the pressure varying means, but now employs uses reverse rotation of charging roller 2 to effect transfer of toner and other contaminants to photoconductive drum 1. Except for the pressure varying means, the construction of the electrophotographic apparatus is the same as shown in FIG. 6.

When start button 56 is depressed, motor M1 is turned on to rotate charging roller 2 at rotational speed V1 in direction B, and motor M2 turned on to rotate photoconductive drum 1 at rotational speed V2 in direction A, where speeds V1 and V2 both are greater than zero. Rotational speeds V1 and V2 are equal to each other during the image area, e.g., between time T=t1 and T=t2.

After time t2 (during non-sensitive phases of operation), the rotational speed of charging roller 2 is reversed to V3=−V1 such that charging roller 2 rotates in a direction opposite B while the rotational speed of photoconductive drum is maintained at speed V2. Toner and other contaminants are transferred from charging roller 2 to photoconductive drum 1 due to the reverse rotation of charging roller 2. Transferred toner and other contaminants are removed by rotating member 6*a* of developing station 6 and/or cleaning station 8.

The reverse rotation is maintained until a sensitive phase of the operation occurs at time T=t'3. If there are other copies to be made, above steps are repeated, starting with rotational speed V1 of charging roller 2 and rotational speed V2 of photoconductive drum being equal to one another. If there are no further copies, motors M1 and M2 are turned OFF to end the copying process.

The transfer mechanism during sensitive phases of operation of the second and third embodiments is identical to the first embodiment, but is different from the first embodiment during non-sensitive phases of operation. FIG. 10C shows the frictional forces on toner near the end of surface contact during non-sensitive phases of operation of the second and third embodiments. When the rotational speed of roller is decreased, increased or reversed, toner slips on charging roller 2. When there is slippage, kinetic friction $F_3$, rather than static friction $F_1$, is exerted on the toner from charging roller 2. Kinetic friction $F_3$ is smaller than static friction $F_1$, which in turn is smaller than the static friction $F_2$ exerted from photoconductive drum 1 to toner. Hence, $$F_3<F_1<F_2,$$

and $$F_{3y}<F_{1y}<F_{2y}.$$

Vertical force vectors $F_{3y}$ and $f_y$ are exerted on toner from charging roller 2, while vertical force vector $F_{2y}$ is exerted on the toner from photoconductive drum 1. For static friction, the adherence force f is a factor in preventing the transfer of toner from charging roller 2 to photoconductive drum 1. However, when toner starts to slip on charging roller 2, adherence force f decreases to zero. Hence, only two vertical vectors $F_{3y}$ and $F_{2y}$ are exerted on toner and other contaminants. Since $F_{3y}$ is less than $F_{2y}$, toner is transferred from charging roller 2 to photoconductive drum 1.

There accordingly has been described unique mechanisms and methodology for cleaning a charging roller of various debris and contamination that tends to adhere to the roller. In the environment of an electrophotographic apparatus wherein the roller is a contact charging element for a photoconductive drum, cleaning of the charging roller is inhibited during sensitive phases of a photocopy cycle, i.e. imagewise exposure, development and transfer of the developed image. During non-sensitive phases of operation, toner and other contaminants are transferred from the charging roller to the photoconductive drum by increasing the frictional force between the roller and drum. Such increase in frictional force can be effected by increasing pressure between the contact surfaces of the roller and drum or by changing or reversing the rotational speeds of the charging roller and photoconductive drum. Removal is subsequently effected by the development station and/or cleaning station.

The foregoing embodiments are merely exemplary and not to be construed as limiting the basic concept of transferring toner and other contaminants from the charge inducing roller member to the photoconductive drum or belt in a variety of electrostatic type apparatuses including, but not limited to, copiers, printers, facsimile machines, etc. Moreover, while a charging roller has been exemplified, the invention is not so limited, and can easily be applied to other rollers, such as the transfer and discharging rollers, and is applicable to any rollers where accumulation of toner and other contaminants prevent quality reproduction and/or compact apparatuses.

We claim:

1. An apparatus comprising:

a photoconductive element;

a roller member maintained in contact with said photoconductive element; and transfer means for transferring toner and other contaminants from said roller member to said photoconductive element, wherein said transfer means comprises pressure varying means for varying the pressure between the contact surfaces of said photoconductive element and roller.

2. The apparatus of claim 1, wherein the transfer means operates during non-sensitive phases of operation.

3. The apparatus of claim 2, wherein the sensitive phases of operation include imagewise exposure, the development of a latent electrostatic image and transfer of the developed image.

4. The apparatus of claim 1, wherein said roller is selected from the group consisting of a charge inducing roller, transfer roller and discharging roller.

5. The apparatus of claim 1, wherein said pressuring varying means applies a first pressure during sensitive phases of operation and a second pressure, greater than the first pressure, during sensitive phases of operation.

6. The apparatus of claim 5, wherein the sensitive phases of operation include imagewise exposure, development of a latent electrostatic image and transfer of the developed image.

7. The apparatus of claim 6, wherein said pressure varying means includes a cam having first and second positions with respect to sensitive and non-sensitive phases of operation, respectively, such that different pressures are applied during sensitive and non-sensitive phases.

8. The apparatus of claim 7, wherein said pressure varying means further comprises a cover and a spring, said spring being coupled to said roller and cover, and said cover being in contact with said cam, wherein said pressuring varying means changes the position of said cam to change the compression of the spring such that different pressures are applied during sensitive and non-sensitive phases of operation.

9. The apparatus of claim 7, wherein said pressure varying means comprises a solenoid, first and second shafts and a lever means for rotating said second shaft, said first shaft being coupled to said first shaft, which first shift is coupled to said lever means, whereby said solenoid is turned on or off to change the position of said cam.

10. The apparatus of claim 1, wherein toner and other contaminants are transferred as a result of generating a frictional force between said photoconductive element and toner and other contaminants during non-sensitive phases of operation which is greater than the frictional force between said roller and toner and other contaminants during sensitive phases of operation.

11. The apparatus of claim 10, wherein the sensitive phases of operation include imagewise exposure, development of a latent electrostatic image and transfer of the developed image.

12. An apparatus comprising:

a photoconductive element;

a roller member maintained in contact with said photoconductive element; and transfer means for transferring toner and other contaminants from said roller member to said photoconductive element, wherein said transfer means comprises speed varying means for changing the rotational speed of said roller.

13. The apparatus of claim 12, wherein the transfer means operates during non-sensitive phases of operation.

14. The apparatus of claim 13, wherein the sensitive phases of operation include imagewise exposure, the development of a latent electrostatic image and transfer of the developed image.

15. The apparatus of claim 12, wherein said roller is selected from the group consisting of a charge inducing roller, transfer roller and discharging roller.

16. The apparatus of claim 12, wherein toner and other contaminants are transferred as a result of generating a frictional force between said photoconductive element and toner and other contaminants during non-sensitive phases of operation which is greater than the frictional force between said roller and toner and other contaminants during sensitive phases of operation.

17. The apparatus of claim 16, wherein the sensitive phases of operation include imagewise exposure, development of a latent electrostatic image and transfer of the developed image.

18. The apparatus of claim 12, wherein said speed varying means increases speed, decreases speed or reverses the rotational direction of said roller to effect transfer of toner and other contaminants from said roller to said photoconductive element.

19. The apparatus of claim 12, wherein said speed varying means comprises a first driving means for rotating said roller at a first rotational speed, and a second driving means for rotating said photoconductive element at a second rotational speed, said first and second rotational speeds being equal during sensitive phases of operation but different during non-sensitive phases of operation.

20. The apparatus of claim 19, wherein the sensitive phases of operation include imagewise exposure, development of a latent electrostatic image and transfer of the developed image.

21. An image forming apparatus comprising:

means for creating a latent image on a photoconductive surface;

means for converting the latent image into a developed image;

means for transferring said developed image onto a predetermined image medium; and means for cleaning toner and other contaminants remaining on the photoconductive surface, wherein the apparatus includes at least one roller in contact with the photoconductive surface for charging or discharging the photoconductive surface, or for transferring the developed image onto the predetermined image medium, and said apparatus further comprising transfer means for transferring toner and other contaminants from said roller to the photoconductive surface, wherein said transfer means comprises means for changing the rotational speed of said roller.

22. The apparatus of claim 21, wherein toner and other contaminants are transferred as a result of generating a frictional force between said photoconductive surface and toner and other contaminants during non-sensitive phases of operation which is greater than the frictional force between said roller and toner and other contaminants during sensitive phases of operation.

23. The apparatus of claim 22, wherein the sensitive phases of operation include imagewise exposure, development of a latent electrostatic image and transfer of the developed image.

24. The apparatus of claim 21, wherein said speed changing means increases, decreases or reverses the rotational speed of said roller to effect transfer of toner and other contaminants from said roller to said photoconductive surface.

25. The apparatus of claim 21, wherein said transfer means comprises a first driving means for rotating said roller at a first rotational speed, and a second driving means for rotating said photoconductive surface at a second rotational speed, said first and second rotational speed being equal during sensitive phases of operation but different during non-sensitive phases of operation.

26. The apparatus of claim 25, wherein the sensitive phases of operation include imagewise exposure, development of a latent electrostatic image and transfer of the developed image.

27. An apparatus comprising:

a photoconductive element;

a roller in contact with said photoconductive element; and pressure varying means for varying the pressure between the contact surfaces of said photoconductive element and roller, wherein said pressure varying means applies a first pressure during sensitive phases of operation and a second pressure, greater than said first pressure, during non-sensitive phases of operation, between the contact surfaces of said photoconductive element and roller.

28. The apparatus of claim 27, wherein the sensitive phases of operation include imagewise exposure, development of a latent electrostatic image and transfer of the developed image.

29. The apparatus of claim 28, wherein said pressure varying means comprises a cam having first and second positions relate to sensitive and non-sensitive phases of operation, respectively, such that said pressure varying means applies first and second predetermined pressures during sensitive and non-sensitive phases of operation, respectively.

30. The apparatus of claim 29, wherein said pressure varying means further comprises a cover and a spring, said spring being coupled to said roller and cover, and said cover being in contact with said cam, wherein said pressuring varying means changes the position of said cam to change the compression of the spring such that first and second predetermined pressures are applied during sensitive and non-sensitive phases of operation, respectively.

31. The apparatus of claim 29, wherein said pressure varying means comprises a solenoid, first and second shafts and a lever means for rotating said second shaft, said first shaft being coupled to said first shaft, said first shaft being coupled to said lever means, and said solenoid being turned on or off to change the position of said cam.

32. An apparatus comprising:

a photoconductive element capable of rotating at a first rotational speed;

a roller in contact with said photoconductive element and capable of rotating at a second rotational speed; and control means for controlling the relative rotational speeds of said photoconductive element and roller so that said first and second rotational speeds are equal during sensitive phases of operation but different during non-sensitive phases of operation.

33. The apparatus of claim 32, wherein the sensitive phases of operation include imagewise exposure, development of a latent electrostatic image and transfer of the developed image.

34. The apparatus of claim 33, wherein said control means increases, decreases or reverses the second rotational speed of said roller to effect transfer of toner and other contaminants from said roller to said photoconductive element during non-sensitive phases of operation.

35. The apparatus of claim 32, wherein said roller is selected from the group consisting of a charging roller, transfer roller and discharging roller.

36. An image forming apparatus comprising:

means for creating a latent image on a photoconductive surface;

means for converting the latent image into a developed image;

means for transferring said developed image onto a predetermined image medium; and means for cleaning toner and other contaminants remaining on the photoconductive surface, wherein the apparatus includes at least one roller in contact with the photoconductive surface for charging or discharging the photoconductive surface, or for transferring the developed image onto the predetermined image medium, and said apparatus further comprising transfer means for transferring toner and other contaminants from said roller to the photoconductive surface, wherein said transfer means comprises pressure varying means for varying the pressure between the contact surfaces of said photoconductive surface and roller.

37. The apparatus of claim 36, wherein said pressuring varying means applies a first pressure during sensitive phases of operations and a second pressure, greater than said first pressure, during non-sensitive phases of operation, between contact surfaces of said photoconductive surface and roller.

38. The apparatus of claim 37, wherein the sensitive phases of operation include imagewise exposure, development of a latent electrostatic image and transfer of the developed image.

39. The apparatus of claim 36, wherein said pressure varying means comprises a cam, said cam having first and second positions related to sensitive and non-sensitive phases of operation, respectively, such that said pressure varying means applies different pressures during sensitive and non-sensitive phases of operation.

40. The apparatus of claim 39, wherein the sensitive phases of operation include imagewise exposure, development of a latent electrostatic image and transfer of the developed image.

41. The apparatus of claim 40, wherein said pressure varying means further comprises a cover and a spring, said spring being coupled to said roller and cover, and said cover being in contact with said cam, wherein said pressuring varying means changes the position of said cam to change the compression of the spring such that different pressures are applied during sensitive and non-sensitive phases of operation.

42. The apparatus of claim 40, wherein said pressure varying means includes a solenoid, first and second shafts and a lever means for rotating said second shaft, said first shaft being coupled to said first shaft, said first shaft being coupled to said lever means, and said solenoid being turned on or off to change the position of said cam.

43. The apparatus of claim 36, wherein toner and other contaminants are transferred as a result of generating a frictional force between said photoconductive surface and toner and other contaminants during non-sensitive phases of operation which is greater than the frictional force between said roller and toner and other contaminants during sensitive phases of operation.

44. The apparatus of claim 43, wherein the sensitive phases of operation include imagewise exposure, development of a latent electrostatic image and transfer of the developed image.

45. A method of removing toner and contaminants from a roller of an image forming apparatus, which method comprises:

rotating a photoconductive element at a first rotational speed while maintaining and roller in contact with the photoconductive element;

rotating the roller at a second rotational speed;

transferring toner and other contaminants from the roller to the photoconductive element; and removing toner and other contaminants from the photoconductive element.

46. The method of claim 45, comprising transferring toner and other contaminants from the roller to the photoconductive element by varying the pressure between the contact surfaces of the photoconductive element and roller.

47. The method of claim 46, comprising varying the pressure between contact surfaces of said photoconductive surface and roller by:

applying a first pressure during sensitive-phases of operation, and applying a second pressure greater than said first pressure, during non-sensitive phases of operation.

48. The method of claim 47, wherein the sensitive phases of operation include imagewise exposure, development of a latent electrostatic image and transfer of the developed image.

49. The method of claim 46, comprising varying said pressure by changing a position of a cam from a first position during sensitive phases of operation to a second position during non-sensitive phases of operation, so that different pressures are applied during sensitive and non-sensitive phases of operation.

50. The method of claim 46, wherein the sensitive phases of operation include imagewise exposure, development of a latent electrostatic image and transfer of the developed image.

51. The method of claim 45, comprising transferring toner and other contaminants from the roller to the photoconductive element by changing the rotational speed of said roller.

52. The method of claim 51, comprising changing the rotational speed of said roller by increasing, decreasing or reversing the rotational speed of said roller to transfer toner and other contaminants from said roller to said photoconductive element.

53. The method of claim 45, comprising transferring toner and other contaminants by generating a frictional force between said photoconductive element and toner and other contaminants which is greater than the frictional force between said roller and toner and other contaminants during non-sensitive phases of operation.

54. The method of claim 53, wherein the sensitive phases of operation include imagewise exposure, development of a latent electrostatic image and transfer of the developed image.

* * * * *